United States Patent [19]

Hittel et al.

[11] Patent Number: 4,463,580

[45] Date of Patent: Aug. 7, 1984

[54] WEFT INSERTION MAGAZINE WITH CONTINUOUS PROVISION OF WEFT THREAD FOR A WARP KNITTING MACHINE

[75] Inventors: Gerhard Hittel, Rodgau; Johann Fiedler, Obertshausen, both of Fed. Rep. of Germany

[73] Assignee: Karl Mayer Textilmaschinenfabrik GmbH, Obertshausen, Fed. Rep. of Germany

[21] Appl. No.: 413,698

[22] Filed: Sep. 1, 1982

[30] Foreign Application Priority Data

Sep. 12, 1981 [DE] Fed. Rep. of Germany ..... 3136181

[51] Int. Cl.[3] ..... D04B 23/06

[52] U.S. Cl. ..... 66/84 A

[58] Field of Search ..... 66/84 A, 85 A; 28/100; 242/129.5, 129.8, 129.7

[56] References Cited

U.S. PATENT DOCUMENTS

| | | | |
|---|---|---|---|
| 1,914,014 | 6/1933 | Gobeille | 242/129.8 X |
| 2,226,024 | 12/1940 | Smith | 242/129.7 X |
| 3,065,926 | 11/1962 | Whitehead et al. | 242/129.7 |
| 3,550,876 | 12/1970 | Mackie | 242/129.8 |
| 3,565,364 | 2/1971 | Numata | 242/129.7 X |
| 3,877,659 | 4/1975 | Takata | 242/129.7 X |
| 4,348,876 | 9/1982 | Roth | 66/84 A |

FOREIGN PATENT DOCUMENTS

| | | | |
|---|---|---|---|
| 2812032 | 10/1978 | Fed. Rep. of Germany | 66/84 A |

*Primary Examiner*—Ronald Feldbaum
*Attorney, Agent, or Firm*—Omri M. Behr

[57] ABSTRACT

A weft thread magazine with constant weft thread delivery for a warp knitting machine has spools, from each of which there are led weft threads. These spools are rotatable about their longitudinal axis and are driven at a speed corresponding to the mean weft thread consumption speed. The weft threads are flat, untwisted ribbons which are fed from the spools tangentially. Between the spools and the thread guides there is a thread storage device. This storage device compensates for the continual thread delivery against the periodically changing weft thread consumption. The spools can be driven so that the weft threads are taken from the spool by at least one roller of a delivery apparatus. The roller is driven at a constant rate of rotation.

8 Claims, 2 Drawing Figures

WEFT INSERTION MAGAZINE WITH CONTINUOUS PROVISION OF WEFT THREAD FOR A WARP KNITTING MACHINE

BACKGROUND OF THE INVENTION

1. Field of the Invention

The invention is directed to a weft insertion magazine for continual provision of weft threads for use with a warp knitting machine having: two separated longitudinal forwarding means including holding devices, a carriage movable to and fro perpendicular thereto, a group of thread guides mounted on the carriage for providing weft threads parallel to each other and for laying them alternately about the holders in first one and then the other longitudinal forwarding means, and a group of spools each providing one weft thread.

2. Discussion of the Relevant Art

Known weft thread magazines of this type (for example, magazine-weft, automatic warp knitting machine KS2/3 MSU produced by applicant's assignee, Mayer Textile Machine Corp.), permit the overhead provision of weft threads from fixed spools which are then provided to the transversely reciprocating thread guides. The take-off of weft threads from the spools follows in consequence of the rhythm of the periodically changing weft thread consumption. It is further known to utilize flat ribbons as weft threads. These ribbons are cut from polyethylene or propropylene sheets in order to manufacture different packaging articles in particular nets. These flat ribbons can be directly utilized, being provided from a sheet slicing machine placed in series with the warp knitting machine (see article from Kettenwirkpraxis February 1974) or they are stretched after slicing and warped onto warp beams (for example the foil-cut-elongating and beaming device with the destination "FSSB" manufactured by Mayer Textile Machine Corp.)

Accordingly, there is a need for an improved weft thread magazine of the above described type, in which untwisted ribbons may be used as weft threads.

SUMMARY OF THE INVENTION

Weft insertion means, according to the principles of the present invention, for feeding a plurality of weft threads to a warp knitting machine has a pair of spaced forwarding means. These forwarding means each have a plurality of spaced holders for carrying weft threads held on the holders in a forward longitudinal direction. Also included is a plurality of thread guides mounted on a carriage for laying the weft threads in parallel about respective ones of the holders. The carriage and guides are operable to transport the weft threads from one of the pair of forwarding means to the other. To accomplish this end, the carriage is mounted adjacent to the forwarding means and can reciprocate transversely with respect thereto. The weft insertion means also has a weft thread storage means and a plurality of spools for delivering tangentially and untwisted from each, one of the weft threads. The threads on the spools comprise flat, untwisted ribbons. Each of the spools are mounted to rotate about its spool axis and are operable to rotate at a tangential speed equivalent to the mean rate of consumption of weft thread by the warp knitting machine. Further, the weft thread storage means can engage the threads between the spools and the thread guides and can compensate for the periodically varying rate of consumption against the continuous delivery of the weft threads.

By employing the foregoing apparatus, thread can be delivered at a varying rate without overly stressing the threads. This problem is solved in the present invention in that the spools are rotatably driven about their longitudinal axis at the mean weft thread consumption speed and fed to weft thread storage means between the spools and the thread guide to provide smoothing between the continual weft provision and the periodically changing weft thread consumption. If ribbon-like threads are handled, twisting can be avoided by taking thread from the spools in a tangential direction.

BRIEF DESCRIPTION OF THE DRAWINGS

In order that the invention may be more fully understood, it will now be described, by way of example, with references to the accompanying drawings in which.

DESCRIPTION OF THE PREFERRED EMBODIMENTS

Figure 1:
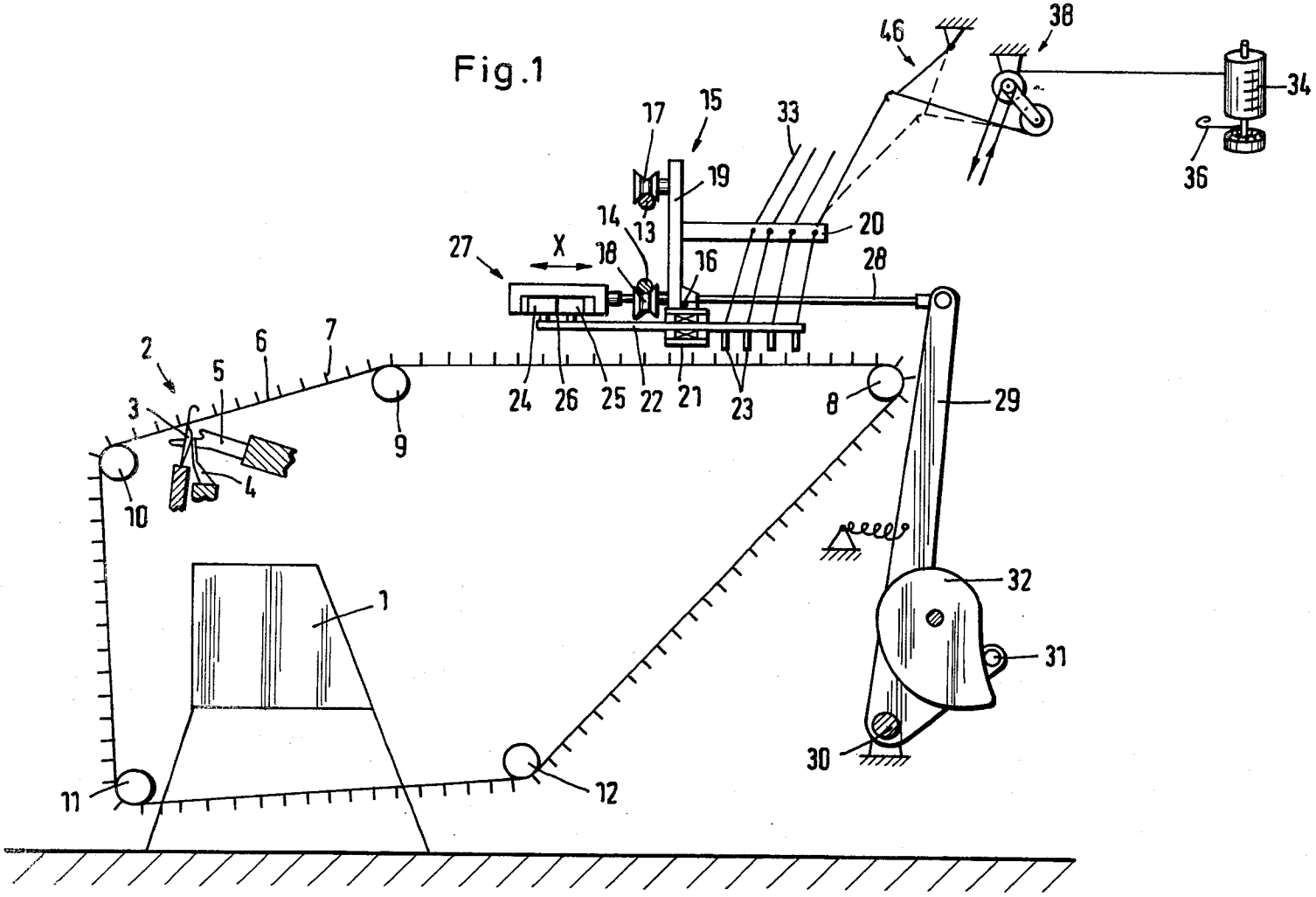
FIG. 1 is a schematic, side, elevational view of a weft magazine on a warp knitting machine according to the principles of the present invention.

The warp knitting machine of FIG. 1 comprises machine frame 1 and its working area 2 comprising needles 3, slider 4, knockover sinkers 5. Elements 3–5 are supported to allow reciprocation in the usual manner so that warp threads (not shown) may be knitted together, one course for each cycle of needles 3. On opposite sides of the needle bed there are provided forwarding means 6 equipped with a plurality of equally spaced holders 7. The forwarding means 6 are generally speaking, formed from a pair of endless, parallel chains. Holders 7 are preferably upright members terminating in a knob, hook or other thread holding device. Forwarding chains 6 travel over a plurality of rollers 9, 10, 11, 12 and 8 in that order and direction, at least one of the rollers being power driven.

Mounted in a direction transverse to chains 6 are two parallel, spaced rails 13 and 14 supporting carriage 15 by its running wheels 17 and 18. So mounted, carriage 15 can reciprocate transversely to forwarding means 6, in a backwards and forwards motion. Running wheels 17 and 18 are journalled onto frame 19 which supports beam 20 having a plurality of spaced thread guides. Frame 19 has a lower bushing 21 slidably supporting rod 22. Rod 22 is in the form of a reciprocating carrier which moves in the direction of arrow "X" and from which several thread guides 23 depend. Two opposing rollers 25 and 24, rotating in the same plane are rotatably mounted on carrier 22 on its end opposite guides 23 (on the same side of bushing 21 as working area 2). Rollers 24 and 25 straddle and engage transverse steel band 26 which at each end thereof is tensioned in cowl-like holding arrangements 27, at least one connected to lever 29 via rod 28. Lever 29 is rotatable about axis 30 and pivotally connected to rod 28 which moves arrangement 27 backwards and forwards in the direction of arrow "X". Rotatably mounted on a lower branch of lever 29 is roller 31. Roller 31 runs on the perimeter of cam disc 32 which rotates at a speed proportional to the cycling rate of machine 1. Simultaneously, carriage 15 moves in the transverse direction.

Figure 2:
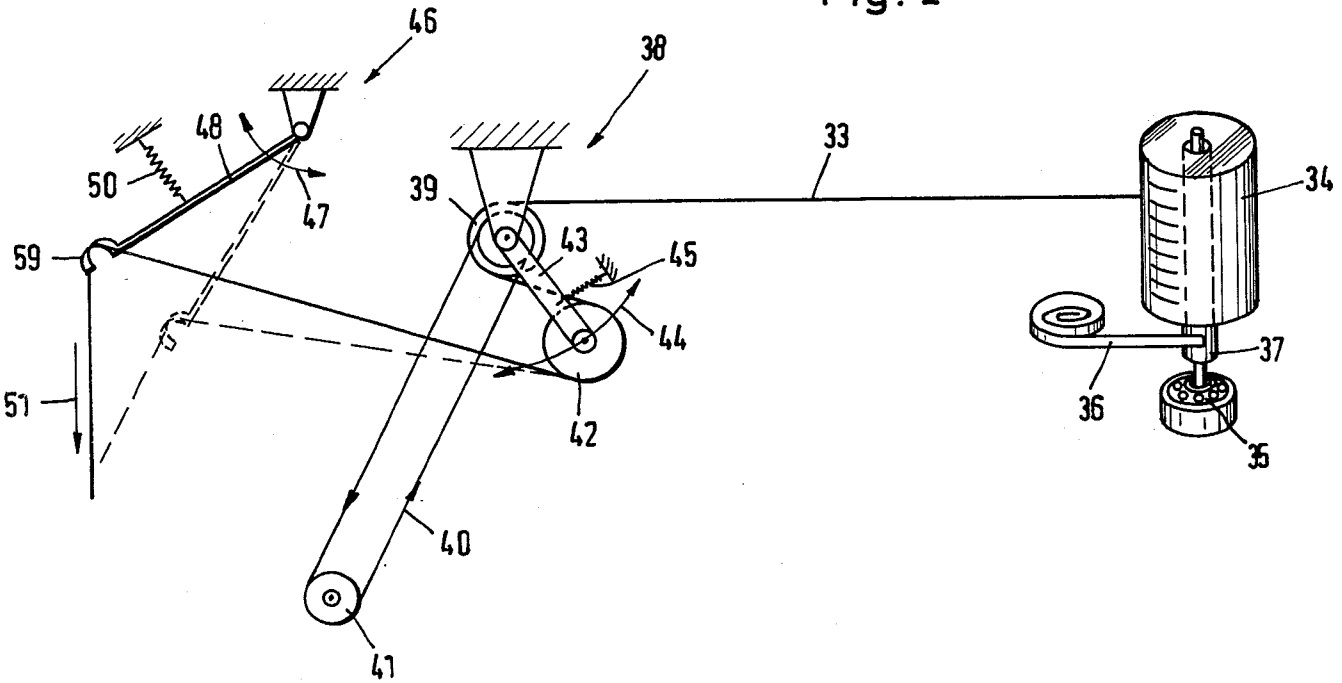
FIG. 2 is a more detailed schematic representation of the spools and the weft thread storage means and other related devices upstream of the thread guides.

Referring to FIGS. 1 and 2, each single weft thread 33 is taken off tangentially from a spool 34 which is rotatable about its longitudinal spool axis (only one shown for clarity). Spool 34 is rotatably mounted on a spindle mounted in ball bearing 35. Spring 36 contacts a collar segment 37 mounted coaxially on the spindle and serves as a brake. A delivery arrangement 38 comprises drive roller 39 which is driven by a driven element 41 by means of a transmission chain or belt 40 which in turn runs synchronously with the main shaft (not shown) of warp knitting machine 1. A turning roller 42 is rotatably mounted in swing lever 43 which is rotatable in the direction of arrow 44 about the fixed axle of drive roller 39. Lever 43 is biased to rotate counterclockwise by tension spring 45.

A weft thread storage means 46 comprises a lever 48 pivotally mounted on a fixed axle to reciprocate in the direction of arrow 47. Lever 48 carries weft thread 33 at its free forward end 59 and is biased by spring 50 in a clockwise direction.

Weft thread 33 is routed from spool 34 over and then under drive roller 39 to roller 42. At roller 42, thread 33 travels over and then under roller 42 before reaching storage arrangement 46. The weft thread 33 is fed to storage arrangement 46 by driven roller 39 at a constant speed. It is taken off from end 59 of lever 48 in the direction of arrow 51 by thread guides 23 with periodic variations in take-off speed. To compensate therefor, lever 48 can move between the position shown in full line and in phantom. Turning roller 42 also is positionable to ensure that weft thread 33 is always sufficiently tensioned against drive roller 39. If the weft thread is too loose, swing lever 43 is caused to move counterclockwise by spring 45 whereby the turning angle is increased and a surer drive of the weft thread is thereby ensured.

In operation forwarding chains 6 are driven in a forward or longitudinal direction. Carriage 15 is moved transversely to chains 6 by means of a reciprocating drive arrangement 16 whereby it is made to come to rest for a short period of time at the end of travel of carriage 15, which occurs when rollers 25 and 24 are positioned in the housing 27 where rearward movement is timed to take place. Carriage 22 is therefore moved in a longitudinal direction parallel to chains 6 as steel band 26 is moved by the steering apparatus coupled to cam 32, via rod 28, as explained earlier. The rearward movement of housing 27 is preferably adjusted to move thread guides 23 a distance which is a multiple of the spacing between holders 7 as determined by cam 32. As the carriage 15 first reverses its transverse motion, threads 33 are wrapped about adjacent ones of holders 7. The foregoing will cause the laying of parallel threads between and perpendicular to chains 6.

It is advantageous that spools 34 are not directly driven but that a continual drive of spools 34 is achieved in that weft threads 33 are pulled off spools 34 by roller 39 rotating at a constant rate of rotation. This permits a simpler mode of construction since on the one hand a driven roller 39 may be utilized for all (or part) of weft threads 33 and on the other hand it is not necessary to provide for adjustment of the drive speed in dependence upon the decreasing spool circumference.

Threads 33 may be ribbon-shaped so that if they were taken off overhead from the conventionally utilized fixed spools, that is axially, the ribbons would become twisted and would no longer be flat. Since the ribbons 33 are, however, taken off from rotatable spools 34 in the tangential direction it is possible to maintain the flat shape of ribbons 33. In this manner it is however not possible to take weft threads 33 directly from the spools 34 by means of the thread guides 23 since the periodically changing takeoff speed leads to a continual speeding up and slowing down of the rotating mass of the spools 34, whereby the weft threads become overloaded and will tear. This problem is solved in that the spools 34 are caused to rotate at a continuous constant speed. The smoothing of this continual thread provision and the periodically changing weft thread consumption by the thread guides 23 is achieved by the provision of weft thread storage device 46. The provision of flat ribbons as weft threads 33 permits the achievement of new types of warp knitted ware and new patterning. Since weft threads 33 are not overloaded by speed increases or decreases of spools 34 the arrangement may also permit higher machine speeds. As thread 33 is pulled off in this manner excessive run-off of thread is prevented by brake 36, should machine 1 be switched off (and also to ensure a certain minimum amount of thread tension). This brake 36, provided in the form of a spring, cooperates with the roller bearings 35 so the net friction does not cause additional complications.

The foregoing consumption of thread 33 by guides 23 is not constant but occurs in successive intervals during which thread 33 is extended in one direction, stopped and laid in the opposite direction. When thread consumption is briefly interrupted, drive roller 39 continues to supply thread 33 thus tending to slacken it. In response both spring 50 and 45 contract, separating end 59 and roller 42 as they move in opposite directions. It is desirable that driven roller 39 of the delivery mechanism is provided with turning roller 42 which is carried in swing lever 43 swingable about the axis of driven roller 39. One benefit of the moving of roller 42 is that it increases the extent of contact of thread 33 with the surface of drive roller 39 to a larger angle. This increase increases the frictional contact of roller 39 when thread 33 has this tendency to slacken.

The foregoing preferred embodiment may be advantageously modified for some applications. For example: Spools 34 may also be directly driven for example in the manner known for warp beams operating at constant velocity. The disclosed weft thread storage device is formed in a very simple manner: there is merely required a swinging arm held under thread tension. In other embodiments the storage device can employ various mechanical means to take up slack and maintain thread tension.

It will be understood that various changes in the details, materials, arrangement of parts and operating conditions which have been herein described and illustrated in order to explain the nature of the invention may be made by those skilled in the art within the principles and scope of instant invention.

What is claimed is:

1. Weft insertion means for feeding a plurality of weft threads to a warp knitting machine comprising:

(a) a pair of spaced forwarding means, each having a plurality of spaced holders, for carrying weft threads held on said holders in a forward, longitudinal direction;

(b) a carriage mounted adjacent to said forwarding means and reciprocatable transversely with respect thereto;

(c) a plurality of thread guides mounted on said carriage for laying said weft threads in parallel about respective ones of said holders, said carriage and guides being operable to transport said weft threads from one of said pair of forwarding means to the other;

(d) a plurality of spools for delivering tangentially and untwisted from each, one of said weft threads, the threads on said spools comprising flat, untwisted ribbons, each of said spools being mounted to rotate about its spool axis; and (e) a delivery arrangement having a drive roller for pulling the weft threads from said spools, said drive roller being operable to rotate at a constant tangental speed equivalent to the mean rate of consumption of weft thread by said knitting machine;

(f) weft thread storage means for engaging said threads between said spools and said thread guides and for compensating for the periodically varying rate of consumption against the continuous delivery of the weft threads.

2. Weft insertion means according to claim 1 wherein each of said spools comprise:

a brake for resisting turning about the spool axis.

3. Weft insertion means according to claim 2 wherein said brake comprises:

a spring member for engaging the associated one of said spools.

4. Weft insertion means according to claim 3 wherein each of said spools comprises:

a spindle for supporting a respective one of said spools; and a roller bearing for rotatably supporting said spindle.

5. Weft insertion means according to claim 2 wherein said delivery arrangement comprises:

a turning roller rotatably mounted to orbit said drive roller.

6. Weft insertion means according to claim 5 wherein said delivery arrangement comprises:

a lever pivoted at one end of said drive roller and supporting at its other end said turning roller; and means for urging said lever to rotate in a predetermined direction.

7. Weft insertion means according to claim 1 or 4 wherein said storage means comprises:

means for deflecting said weft threads and increasing their path length in response to a lessening of their tension.

8. Weft thread insertion means according to claim 1 wherein said storage means comprises:

a spring-biased lever arm for engaging said weft threads.

* * * * *